US005758676A

United States Patent [19]

Duckwall et al.

[11] Patent Number: 5,758,676

[45] Date of Patent: Jun. 2, 1998

[54] SUPPORT-DOOR HINGE

[75] Inventors: Thomas Duckwall, Roanoke, Va.; Bradley B. Hobday, Goldsboro, N.C.

[73] Assignee: White Consolidated Industries, Inc., Cleveland, Ohio

[21] Appl. No.: 692,745

[22] Filed: Aug. 6, 1996

[51] Int. Cl.[6] ..... A47L 15/42

[52] U.S. Cl. ..... 134/201; 248/672; 248/676; 312/228; 312/328

[58] Field of Search ..... 134/201; 312/228, 312/265.4, 327, 328; 248/672, 676

[56] References Cited

U.S. PATENT DOCUMENTS

| | | | |
|---|---|---|---|
| 292,005 | 1/1884 | Gilfillan . | |
| 2,565,129 | 8/1951 | Hermani . | |
| 2,657,697 | 11/1953 | Walker . | |
| 3,000,049 | 9/1961 | Terry, Jr. . | |
| 3,284,842 | 11/1966 | Jennings, Jr. . | |
| 3,921,252 | 11/1975 | Guth | 16/142 |
| 3,962,750 | 6/1976 | Buss et al. | 16/168 |
| 4,115,901 | 9/1978 | Schmidt | 16/176 |
| 4,359,250 | 11/1982 | Jenkins | 312/228 |
| 4,412,710 | 11/1983 | Laprad et al. | 312/311 |
| 4,746,177 | 5/1988 | Lampman et al. | 312/228 |
| 4,787,121 | 11/1988 | Racenis et al. | 16/356 |
| 4,900,109 | 2/1990 | Boston, Jr. et al. | 312/276 |
| 4,940,298 | 7/1990 | Jackson et al. | 312/228 |
| 5,215,365 | 6/1993 | Godin | 312/328 |
| 5,345,959 | 9/1994 | Matteson | 134/201 |
| 5,515,876 | 5/1996 | Warner et al. | 134/57 D |

*Primary Examiner*—Philip R. Coe
*Attorney, Agent, or Firm*—Pearne, Gordon, McCoy & Granger LLP

[57] ABSTRACT

A washer having a tub supported by a front frame, a pair of front supports and a rear frame. The tub defines a wash chamber with a front opening. The front frame has a pair of vertical members respectively disposed adjacent to the opposing side walls of the tub toward the front opening. The front supports each have a nose extending forward from a neck. The necks are respectively secured to lower ends of the vertical members. A door is pivotally secured to the noses of the front supports. A door hinge support is secured between the noses of the front supports so as to secure the front supports from lateral movement.

20 Claims, 6 Drawing Sheets

SUPPORT-DOOR HINGE

BACKGROUND OF THE INVENTION

1. Field of the Invention

This invention relates to washers in general and, more particularly, to hinge structures for dishwashers.

2. Description of the Related Art

A tub for a washer, such as dishwasher, often has an integrally molded plastic construction and a front opening for providing access to an interior wash chamber. Typically, the tub includes a pair of side walls and a top wall, all of which flare outward near the front opening so as to form a collar with a recessed shoulder. A door is provided for closing the front opening. The door seats against a recessed shoulder so as to form a seal with the tub.

With plastic tubs, a frame is provided to support the tub. Typically, the frame includes a front frame and a rear frame. The front frame is commonly horseshoe-shaped and has a pair of parallel vertical legs that project downward from a bight. The front frame abuts an exterior surface of the collar and helps prevent lateral movement of the tub. The support frame usually has a rear support member that is secured to a pair of horizontal legs that project forward toward the front of the tub. The vertical legs of the front frame extend downward to the horizontal legs of the support frame and are secured thereto.

The washer is provided with a hinge structure to pivotally mount the door to the frame. The hinge structure usually includes a pair of mounting plates, hinge pins and hinge arms. The mounting plates are composed of metal and are typically secured to lower portions of the vertical legs by welding. The mounting plates extend forward from the vertical legs and terminate at outer ends.

The hinge arms are secured to opposing sides of the door. Each of the hinge arms typically has an elongated body and a head with an opening formed therein. The door is pivotally secured to the mounting plates by pintles that extend through the openings in the heads. The pintles are either secured to the outer ends of the mounting plates or are pivotally received within holes formed in the outer ends of the mounting plates. The door is movable between a closed position wherein the door covers the front opening and an open position wherein the door is spaced from the front opening. In the closed position, the door is substantially vertical, while in the open position, the door is substantially horizontal.

With the door pivotally secured to the mounting plates in the foregoing manner, the weight of the door can cause the mounting plates and the lower portions of the vertical legs to pivot laterally inward or outward. Such lateral pivoting of the mounting plates laterally moves the door out of alignment with the recessed shoulder of the tub, thereby adversely affecting the seal between the door and the tub. In some prior art washers, a front brace is welded between the vertical legs in order to help secure the door from lateral movement. Such front braces, however, still permit some lateral movement of the door. Accordingly, there is a need in the art for a washer having a structure that helps eliminate lateral movement of a horizontal-pivoting door. The present invention is directed to such a washer.

SUMMARY OF THE INVENTION

It therefore would be desirable, and is an advantage of the present invention, to provide a washer having a structure that helps eliminate lateral movement of a horizontal-pivoting door. In accordance with the present invention, the washer includes a tub, a front frame, a pair of front supports, a door and a door hinge support. The tub defines a wash chamber with a front opening and has a bottom wall and opposing side walls. The front frame has a pair of vertical members respectively disposed adjacent to the opposing side walls of the tub toward the front opening. The vertical members each have a lower end. The front supports each have a neck and a nose. The necks are respectively secured to the lower ends of the vertical members and the noses extend forward from the necks. The door is pivotally secured to the noses of the front supports so as to be movable between an open position and a closed position. The door hinge support is secured between the noses of the front supports so as to secure the front supports from lateral movement.

Also provided in accordance with the present invention is a washer having a tub, a front frame, a pair of mounting plates, a door, a pair of hinge arms, a door hinge support and a pair of hinge pins. The tub defines a wash chamber with a front opening and has a bottom wall and opposing side walls. The front frame has a pair of legs respectively disposed adjacent to the opposing side walls of the tub toward the front opening. The mounting plates are secured to the legs of the front frame and extend forward therefrom. The mounting plates each define a mounting hole. The door has a pair of opposing side members. The hinge arms are secured to the opposing side members of the door. The hinge arms each define an opening. The hinge arms are disposed adjacent to the mounting plates such that the openings in the hinge arms are aligned with the mounting holes in the mounting plates so as to form a pair of hinge passages. The door hinge support extends between the mounting plates and has opposing ends. The door hinge support defines an inner bore that extends through the opposing ends. The hinge pins respectively extend through the hinge passages and are securely received within the inner bore at the opposing ends of the door hinge support, thereby pivotally securing the door to the mounting plates and securing the door hinge support between the mounting plates.

Also provided in accordance with the present invention is a washer including a tub, a front frame, a pair of front supports, a door, a pair of hinge arms, a door hinge support and a pair of hinge pins. The tub defines a wash chamber with a front opening and has a bottom wall and opposing side walls. The front frame has a pair of vertical members respectively disposed adjacent to the opposing side walls of the tub toward the front opening. The vertical members each have a lower end. The front supports each have a neck and a nose. The necks are respectively secured to the lower ends of the vertical members. The noses extend forward from the necks and each have a mounting hole formed therein. The door has a pair of opposing side members. The hinge arms are secured to the opposing side members of the door. The hinge arms each define an opening. The hinge arms are disposed adjacent to the noses of the front supports such that the openings in the hinge arms are aligned with the mounting holes in the noses so as to form a pair of hinge passages. The door hinge support extends between the noses of the front supports and has opposing ends. The door hinge support defines an inner bore that extends through the opposing ends. The hinge pins respectively extend through the hinge passages and are securely received within the inner bore at the opposing ends of the door hinge support, thereby pivotally securing the door to the front supports and securing the door hinge support between the noses of the front supports.

BRIEF DESCRIPTION OF THE DRAWINGS

The features, aspects, and advantages of the present invention will become better understood with regard to the following description, appended claims, and accompanying drawings where:

DETAILED DESCRIPTION OF THE PREFERRED EMBODIMENTS

Figure 1:
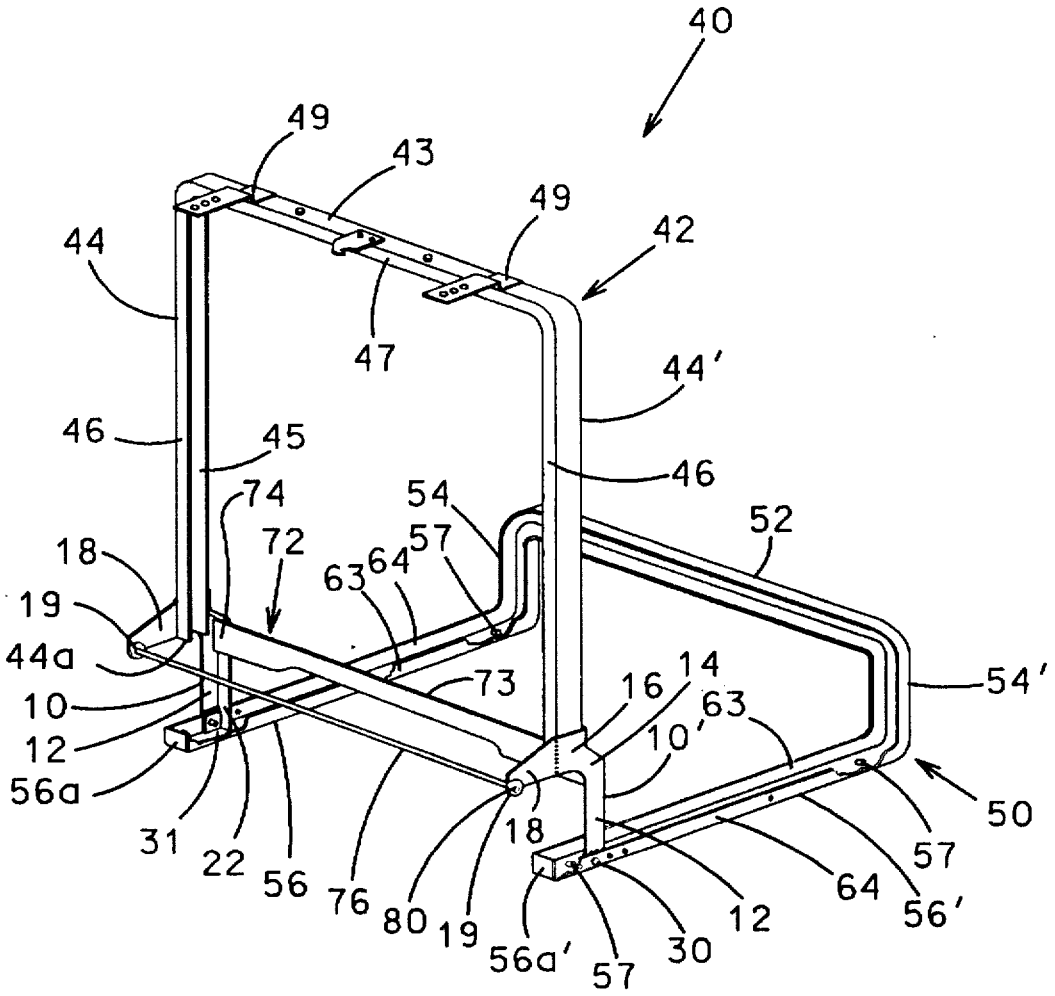
FIG. 1 shows a front perspective view of a frame including a door hinge support.

It should be noted that in the detailed description which follows, identical components have the same reference numerals, regardless of whether they are shown in different embodiments of the present invention. It should also be noted that in order to clearly and concisely disclose the present invention, the drawings may not necessarily be to scale and certain features of the invention may be shown in somewhat schematic form.

Referring now to FIG. 1 there is shown a perspective view of a frame 40 that includes a door hinge support 76 embodied in accordance with the present invention. The frame generally includes the door hinge support 76, first and second offset legs 10, 10', a door or front frame 42, a support or rear frame 50, and a front brace 72.

The structure and mounting of the first and second offset legs 10, 10' is more fully described in assignee's co-pending application entitled "OFFSET LEG", Serial No. 08/690558, which is incorporated herein by reference. The first offset leg 10 and the second offset leg 10' are mirror images of each other and are each formed from a single piece of rigid steel. The first offset leg 10 and the second offset leg 10' each include an upright member 12, a shoulder 14, a neck 16 and a nose 18.

The upright member 12 has a lower end and an upper end. The lower end has an indented outer surface and a raised inner surface. A hole is formed in the lower end. The upper end is integrally joined with the shoulder 14, which extends upward and forward from the upright member 12 to the neck 16. An upright flange 22 extends inward from a rear edge of the upright member 12, while a shoulder flange extends inward from a rear edge of the shoulder 14. The upright flange 22 defines a hole disposed toward the lower end.

The neck 16 is integrally joined with the shoulder 14 and extends upward therefrom. In this manner, the shoulder 14 offsets the neck 16 from the upright member 12 so that the neck 16 is disposed forward of the upright member 12. A neck flange extends inward from a rear edge of the neck 16 and is integrally joined with the shoulder flange, which is, in turn, integrally joined with the upright flange 22.

The nose 18 is integrally joined with the neck 16 and has a bottom edge, a downward sloping top edge and a mounting projection 19. The nose 18 is inwardly offset from the neck 16 so as to form a vertical ridge at the juncture of the neck 16 and the nose 18. The nose 18 extends forward from the neck 16 to the mounting projection 19. The mounting projection 19 has an indented outer surface **19*a* (shown in FIG. 5) and a raised inner surface 19*b* (shown in FIG. 5). The mounting projection 19** defines a mounting hole and has an arcuate bottom edge that extends downward from, and is adjoined to, the bottom edge.

The front frame 42 is composed of steel and has a channel-shaped cross-section. The front frame 42 is formed to have an inverted U-shaped configuration and includes a bight 43, first and second downward-projecting legs 44, 44', and a pair of mounting clips 49. The first downward-projecting leg 44 has a lower end **44*a* and the second downward-projecting leg 44' has a lower end (not shown). In addition, the first and second downward-projecting legs 44, 44' each have an interior flange 45 and an exterior flange 46 that extend inward. The bight 43 has an interior flange (not shown) and an exterior flange (not shown) that extend downward. The mounting clips 49 are secured to the bight 43** and extend forward therefrom.

The rear frame 50 is also composed of steel and has a channel-shaped cross-section. The rear frame 50, however, is formed to have a folded U-shaped configuration and includes a horizontal cross bar 52 with opposing ends that bend into first and second vertical legs 54, 54'. The first and second vertical legs 54, 54', in turn, respectively bend into first and second horizontal legs 56, 56' that extend forward and terminate at outer ends **56*a*, 56*a'* respectively. A plurality of vertical holes 57 are formed in each of the first and second horizontal legs 56, 56'**.

The first and second horizontal legs 56, 56' each have an inner flange 63 and an outer flange 64 that extend upward. Lateral bores are formed in the outer flanges 64 toward the outer ends **56*a*, 56*a'* of the first and second horizontal legs 56, 56'. The lateral bores are aligned with the holes in the upright members 12 of the first and second offset legs 10, 10'. The first and second horizontal legs 56, 56' are respectively secured to the lower ends of the first and second offset legs 10, 10' by bolts. The bolts have heads 30 disposed adjacent to exterior sides of the outer flanges 64. The bolts extend through the lateral bores and the holes in the lower ends and are fitted with nuts 31** disposed adjacent to the interior surfaces of the lower ends.

The lower end **44*a* of the first downward-projecting leg 44 is secured to the neck 16 of the first offset leg 10, while the lower end of the second downward-projecting leg 44' is secured to the neck 16 of the second downward-projecting leg 44'. The first and second downward-projecting legs 44, 44' are secured to the necks 16** using metal clinches. As used herein, the term "metal clinch" shall refer to a joint formed by a TOX® round joint method.

The TOX® round joint method is a method of joining two pieces of metal covered by European Patent No. EP 0 215 449 and marketed by TOX-PRESSOTECHNIK, INC. of Addison, Ill. In the TOX® round joint method a round punch presses a top material and a bottom material into a die cavity. As force is increased on the punch, the top material is forced to spread out within the bottom material, thereby forming a metal clinch that joins the top and bottom materials. The metal clinch resembles a dove-tail joint. It is considered apparent that the present invention is not limited to the use of metal clinches to join the various components of the frame 40. Other joining means such as welding may be employed with equal functionality and without departing from the scope and spirit of the present invention as embodied in the claims appended hereto.

Three metal clinches are formed between the lower end **44*a* of the first downward-projecting leg 44 and the neck 16 of the first offset leg 10. Three metal clinches are also formed between the lower end of the second downward-projecting leg 44' and the neck 16 of the second offset leg 10'. With the first and second downward-projecting legs 44, 44' secured to the first and second offset legs 10, 10' in this manner, the interior flanges 45 of the first and second downward-projecting legs 44, 44' adjoin the neck flanges on the first and second offset legs 10, 10'. In addition, the exterior flanges 46 on the first and second downward-projecting legs 44, 44' adjoin the vertical ridges in the first and second offset legs 10, 10'**.

The front brace 72 is comprised of metal and has a narrow middle portion 73, a first end 74 and a second end (not shown). The front brace 72 is secured between the first and second offset legs 10, 10'. Specifically, the first end 74 of the front brace 72 is secured to the upright flange 22 of the first offset leg 10 by two metal clinches, while the second end of the front brace 72 is secured to the upright flange 22 of the second offset leg 10' by two metal clinches.

Figure 2:
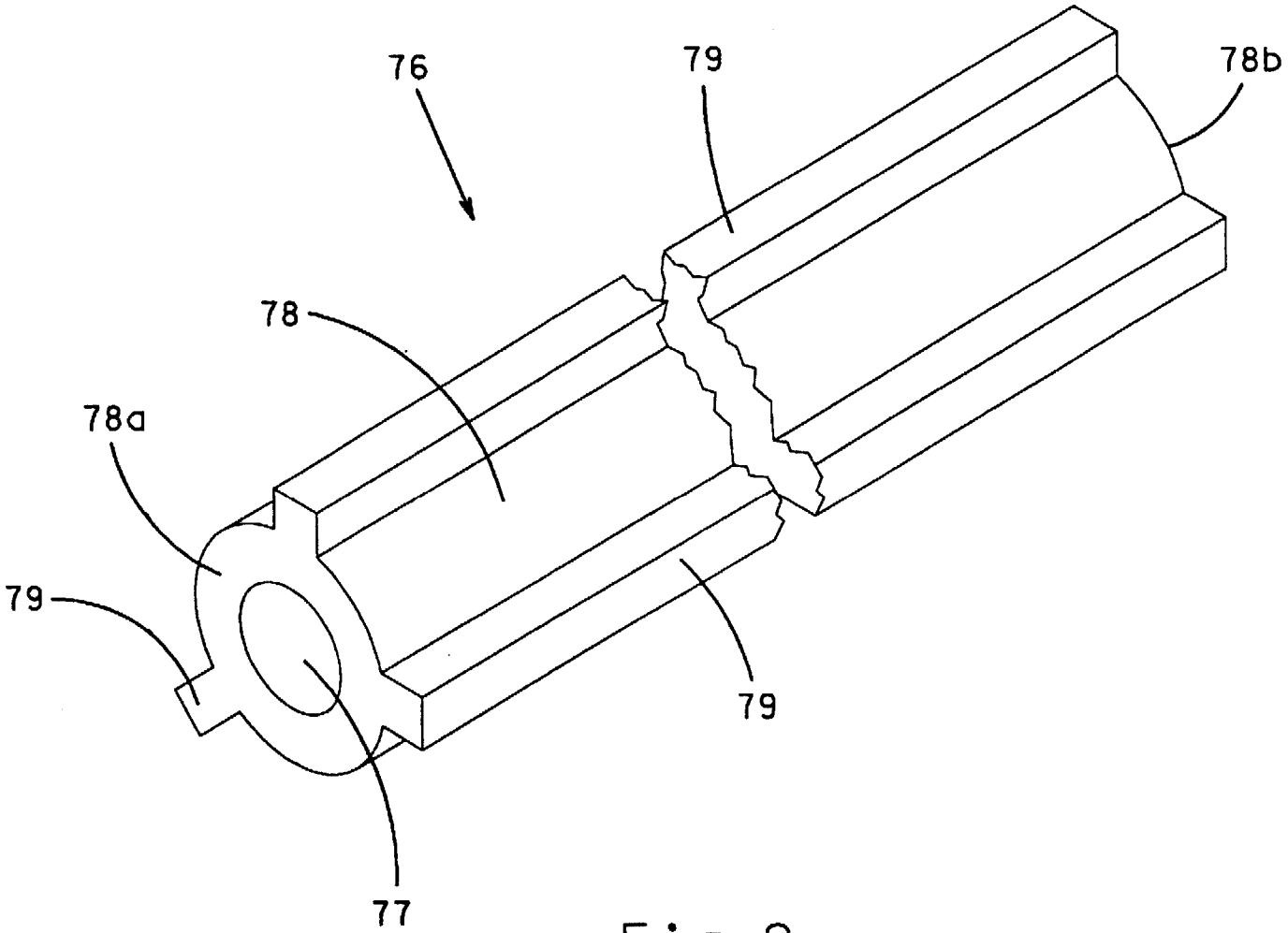
FIG. 2 shows a perspective view of portions of the door hinge support.
Figure 5:
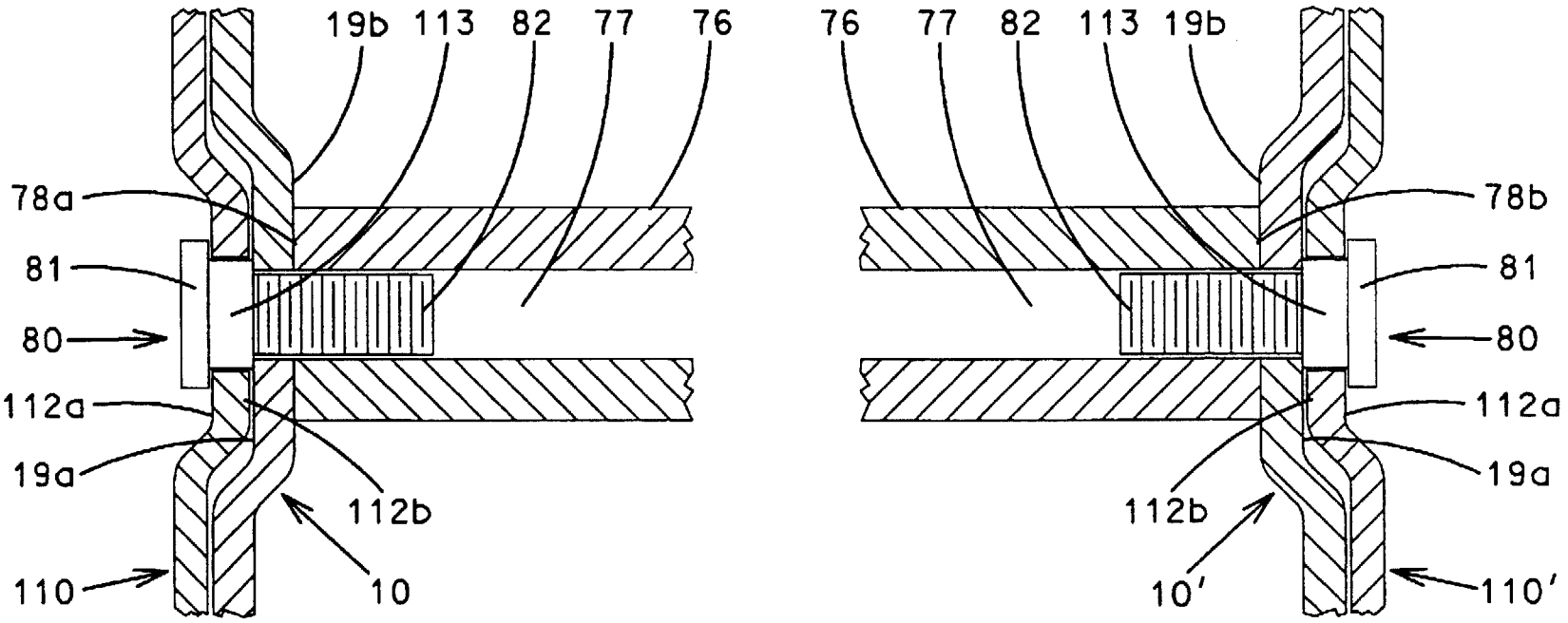
FIG. 5 shows partial sectional views of a hinge structure taken along line 5—5 in FIG. 4.

Referring now also to FIG. 2, the door hinge support 76 is composed of aluminum and has a cylindrical body 78 with a first end **78*a* and a second end 78*b*. The body 78 defines an inner bore 77 that extends between the first and second ends 78*a*, 78*b*. A plurality of fins 79 extend the length of the body 78 and project radially outward therefrom. The fins 79 help strengthen the door hinge support 76. The door hinge support 76 is secured between the mounting projections 19 of the first and second offset legs 10, 10' by hinge pins 80 that extend through the mounting holes in the first and second offset legs 10, 10' and are securely received within the inner bore 77 at the first and second ends 78*a*, 78*b*, respectively, as is shown in FIG. 5**.

Figure 3:
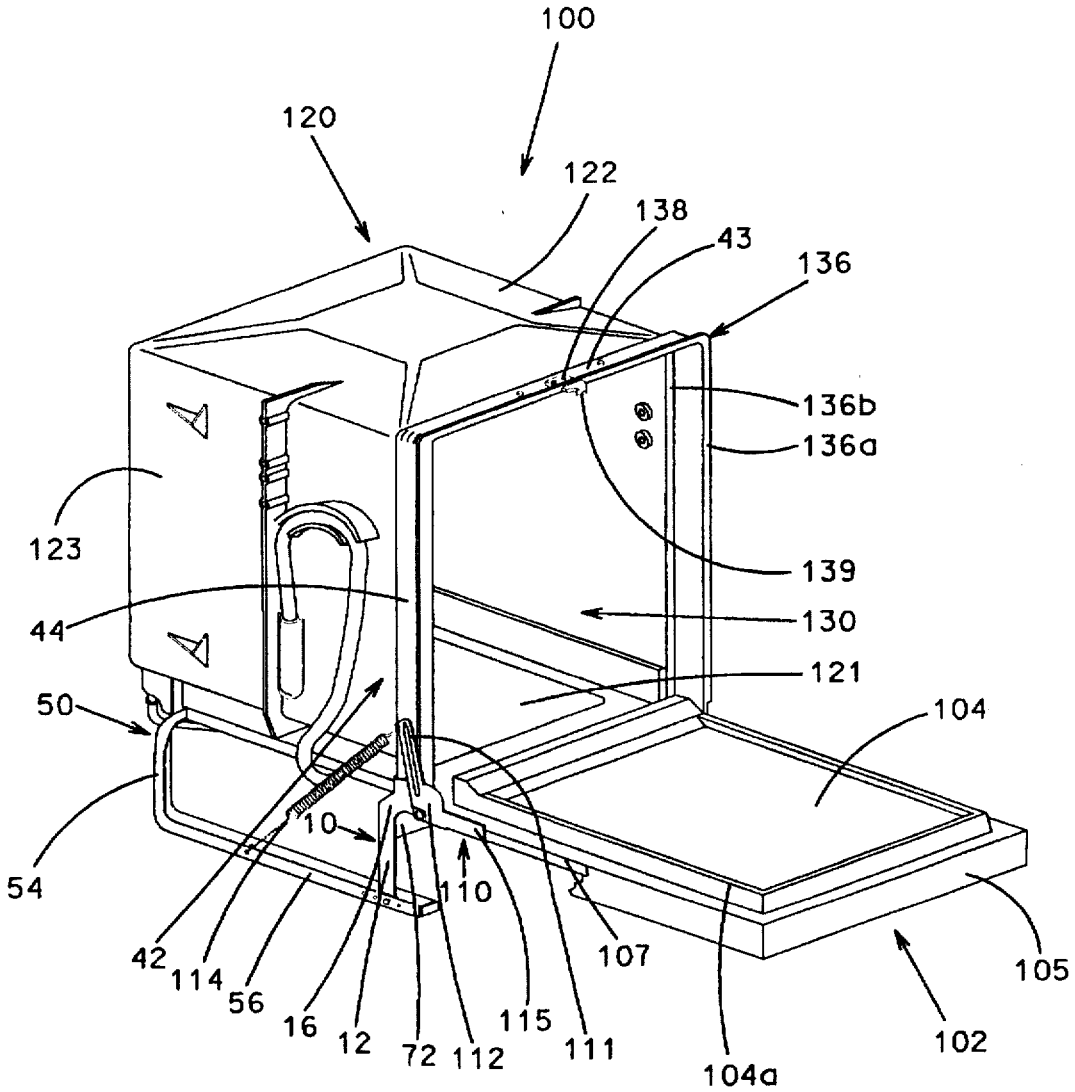
FIG. 3 shows a front perspective view of a first embodiment of a washer that includes the frame and a door in an open position.

Referring now to FIG. 3 there is shown a perspective view of a washer 100, such as a dishwasher, that generally includes the frame 40, a door 102, and a tub 120. The tub 120 has an integrally molded plastic construction and defines an access opening 130. The tub 120 includes a bottom wall 121, a top wall 122, a pair of opposing side walls 123 and a rear wall (not shown). The exterior of the bottom wall 121 has integrally molded ribs (not shown) and blocks (not shown) projecting downward therefrom. The blocks are cantilevered and form grooves with the ribs. The side walls 123 and the top wall 122 flare outward near the access opening 130 so as to form a collar 136 around the access opening 130. The collar 136 has an outer flange **136*a* and an interior recessed shoulder 136*b* that provides a seat for the door 102**.

The front frame 42 is disposed around the collar 136 of the tub 120 on an interior side of the outer flange **136*a*. A mounting plate 138 is centrally mounted to the bight 43 of the front frame 42 on the interior side of the outer flange 136*a*. Located on an exterior side of the outer flange 136*a* is a striker 139. The mounting plate 138 and the striker 139 are secured together with the outer flange 136*a* firmly clamped in between. In this manner, the front frame 42 is rigidly attached to the tub 120**.

The horizontal cross bar 52 of the rear frame 50 supports a rear portion of the bottom wall 121 of the tub 120, while the front brace 72 supports a front portion of the bottom wall 121 of the tub 120. The horizontal cross-bar 52 is disposed within the grooves between the ribs and the blocks so as to prevent forward and rearward movement of the tub 120 as well as upward and downward movement of the tub 120.

The frame 40 supports and secures the tub 120 and other components of the washer 100. The front frame 42 helps prevent lateral movement and vertical deformation of the tub 120, while the rear frame 50, the first and second offset legs 10, 10', and the front brace 72 support the tub 120 and other components of the washer 100. The rear frame 50 also engages the bottom wall 121 of the tub 120 so as to prevent forward, rearward and vertical movement of the tub 30.

Figure 4:
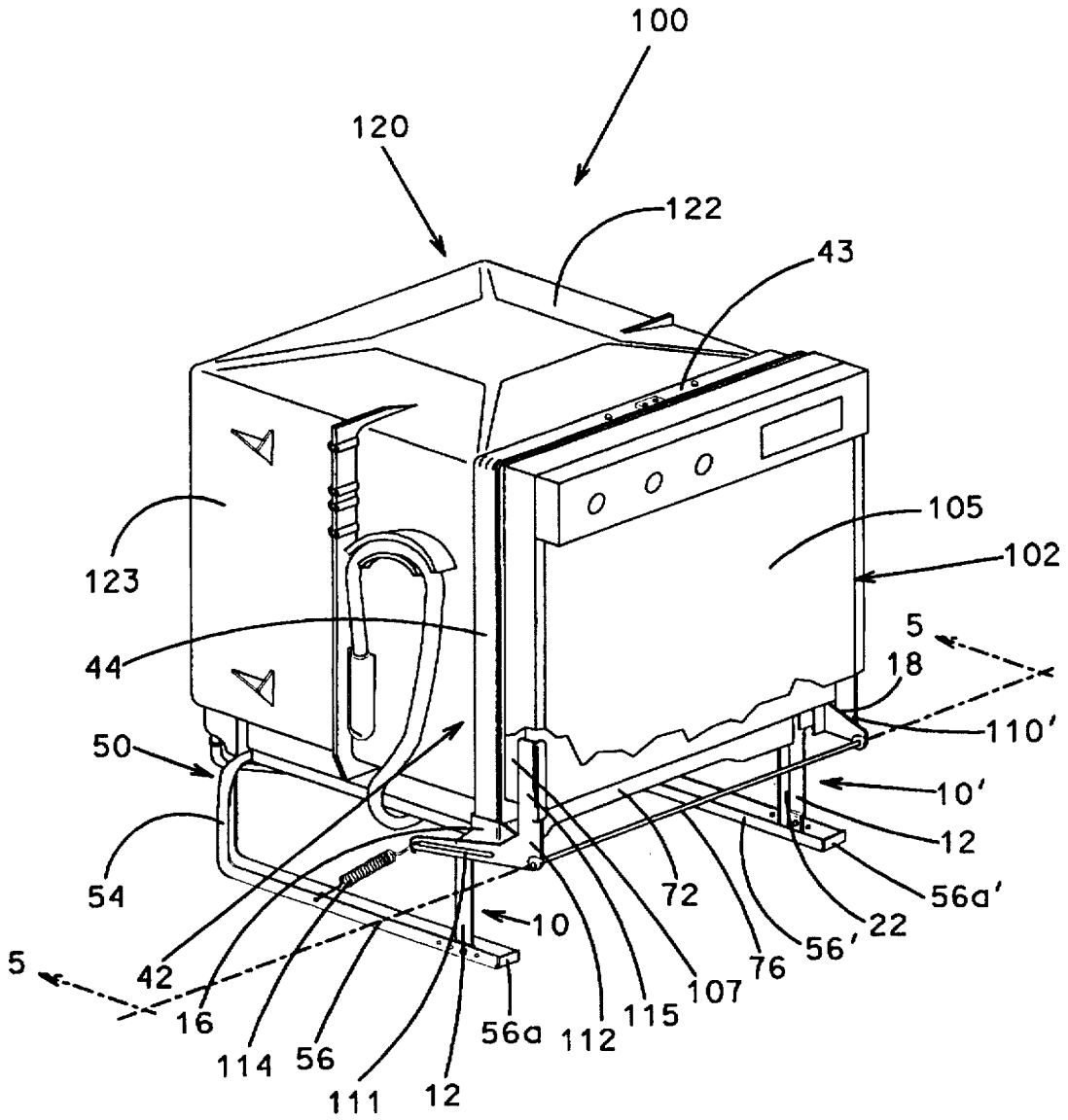
FIG. 4 shows a front perspective view of the first embodiment of the washer with the door in a closed position and with portions of the door cut-away.

Referring now also to FIG. 4, the door 102 includes a reinforcement frame, a liner 104 and an outer panel 105. The liner 104 has an interior edge **104*a* that extends along a top and opposing sides of the liner 104. The reinforcement frame includes a first side member 107 and a second side member (not shown). The door hinge support 76 extends behind the outer panel 105 and is spaced below the liner 104**.

A first hinge arm 110 and a second hinge arm 110' are respectively secured to the first side member 107 and the second side member of the reinforcement frame. Each of the first and second hinge arms 110, 110' is generally L-shaped and includes an elongated member 111, a mounting member 115 and an elbow 112 with an opening formed therein. The mounting members 115 are secured to the first side member 107 and the second side member of the reinforcement frame by screws and nuts. The elbows 112 of the first and second hinge arms 110, 110' each have a recessed outer surface **112*a* (shown in FIG. 5) and a protruding inner surface 112*b* (shown in FIG. 5). An annular bearing surface 113 (shown in FIG. 5) is disposed around an inner periphery of each of the openings in the elbows 112**.

The first and second hinge arms 110, 110' are pivotally connected to the first and second offset legs 10, 10' by the hinge pins 80, which extend through the openings in the elbows 112. The elongated members 111 of the first and second hinge arms 110, 110' are biased downward and rearward by springs 114 connected between the elongated members 111 and the first and second horizontal legs 56, 56'. In this manner, the springs 114 bias the first and second hinge arms 110, 110' to pivot counterclockwise as viewed from the first hinge arm 110.

Together, the first and second offset legs 10, 10', the first and second hinge arms 110, 110', the door hinge support 76 and the hinge pins 80 form a hinge structure that permits the door 102 to pivot about a horizontal axis passing through the hinge pins 80. The horizontal axis is spaced upward from a bottom edge of the door 102. Thus, the door 102 has a long bottom portion and is considered a "long door".

The door 102 pivots about the horizontal axis between a closed position and an open position. In FIG. 3, the door 102 is shown in the open position, whereas in FIG. 4, the door 102 is shown in the closed position. In the open position, the door 102 is horizontal and is spaced from the access opening 130 so as to permit access to the tub 120. In the closed position, the door 102 is vertical and covers the access opening 130. When the door 102 is in the closed position, the interior edge **104*a* of the liner 104 seats against the interior recessed shoulder 136*b* so as to form a seal with the tub 120, thereby preventing wash fluid from leaking out of the tub 120. The springs 114 bias the door 102 to pivot upward toward the closed position, whereas the weight of the door 102 biases the door 102 to pivot downward toward the open position. Accordingly, the springs 114 act as a counterbalance to the weight of the door 102**.

Referring now to FIG. 5 there are shown partial sectional front views of the hinge structure taken along line 5—5 in FIG. 4. The first end **78*a* of the door hinge support 76 abuts the raised inner surface 19*b* of the first offset leg 10, while the second end 78*b* of the door hinge support 76 abuts the raised inner surface 19*b* of the second offset leg 10'. The protruding inner surfaces 112*b* of the first and second hinge arms 110, 110' are respectively disposed adjacent to the indented outer surfaces 19*a*** of the first and second offset legs 10, 10'. The inner bore 77 at the first end 78*a* of the door hinge support 76 is aligned with the mounting hole in the first offset leg 10 and the opening in the first mounting arm 110 so as to form a first mounting passage. Similarly, the inner bore 77 at the second end 78*b* of the door hinge support 76 is aligned with the mounting hole in the second offset leg 10' and the opening in the second mounting arm 110' so as to form a second mounting passage.

The hinge pins 80 are self-tapping and each have a head 81 and a body 82. The bodies 81 of the hinge pins 80 are respectively secured within the first and second mounting passages, while the heads 81 of the hinge pins 80 respectively adjoin the recessed outer surfaces 112*a* of the first and second hinge arms 110, 110'. The bodies 81 respectively extend through the annular bearing surfaces 113 in the first and second hinge arms 110, 110', thereby permitting the first and second hinge arms 110, 110' to pivot about the hinge pins 80. In this manner, the hinge pins 80 pivotally secure the first and second hinge arms 110, 110' to the first and second offset legs 10, 10'.

The hinge pins 80 pull the noses 18 of the first and second offset legs 10, 10' against the first and second ends 78*a*, 78*b* of the door hinge support 76. As a result, the raised inner surface 19*b* of the first offset leg 10 is pressed substantially flush against the first end 78*a* and the raised inner surface 19*b* of the second offset leg 10' is pressed substantially flush against the second end 78*b*, thereby substantially preventing the noses 18 of the first and second offset legs 10, 10' from pivoting out of plane with the first and second ends 78*a*, 78*b* of the door hinge support 76. By substantially preventing such pivoting of the noses 18, the door hinge support 76 helps prevent lateral movement of the door 102. Preventing lateral movement of the door 102, in turn, maintains the alignment of the interior edge 104*a* of the liner 104 with the interior recessed shoulder 136*b*, thereby helping maintain the seal between the tub 120 and the door 102.

Figure 6:
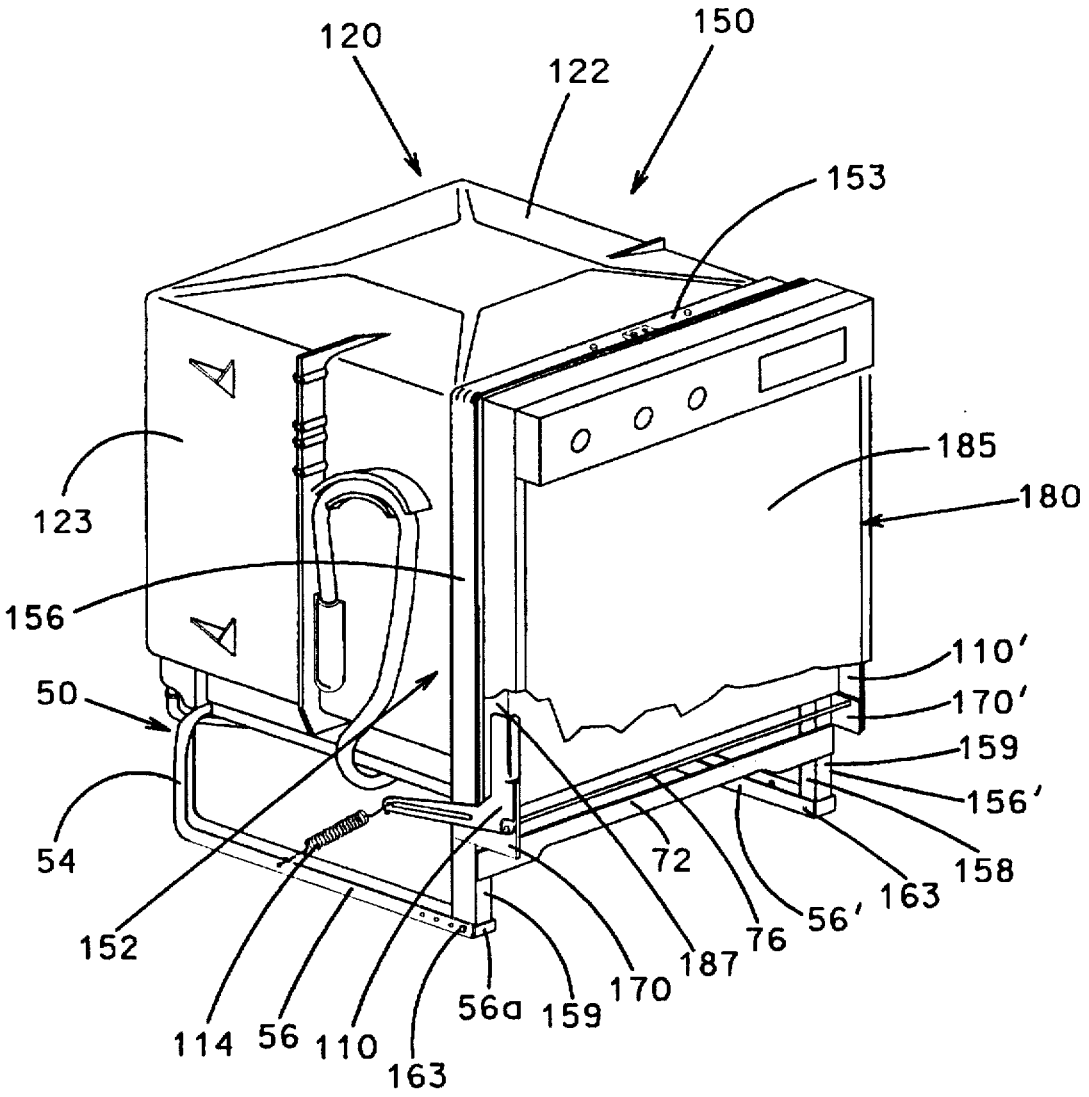
FIG. 6 shows a front perspective view of a second embodiment of the washer.

It should be appreciated that the door hinge support 76 is not limited to use with the first and second offset legs 10, 10'. Referring now to FIG. 6, there is shown a second embodiment of the present invention. Specifically, FIG. 6 shows a washer 150 having essentially the same construction as the washer 100 shown in FIGS. 3, 4 except for the differences to be hereinafter described. In the washer 150, the first and second offset legs 10, 10' and the front frame 42 have been replaced with an anterior frame 152. In addition, the door 102, which is a "long door", has been replaced with a door 180, which is a "short door". A portion of the door 180 has been cut-away to better show the door hinge support 76. The door 180 includes an outer panel 185 and a reinforcement frame having a first side member 187 and a second side member.

The anterior frame 152 is composed of steel and has a channel-shaped cross-section. The anterior frame 152 is formed to have an inverted U-shaped configuration and includes a bight 153 and first and second legs 156, 156'. The first and second legs 156, 156' each have a lower end (not shown) defining a lateral hole. In addition, the first and second legs 156, 156' each have an interior flange 158 and an exterior flange 159 that extend inward. The bight 153 has an interior flange (not shown) and an exterior flange (not shown) that extend downward.

The anterior frame 152 is disposed around the collar 136 of the tub 120 on an interior side of the outer flange 136*a*. The first and second legs 156, 156' of the anterior frame 152 extend downward from the bight 153 all the way to the first and second horizontal legs 56, 56' of the rear frame 50. The lower ends of the first and second legs 156, 156' are respectively secured to the first and second horizontal legs 56, 56' of the rear frame 50 by bolts 163. The bolts 163 extend through the lateral bores in the first and second horizontal legs 56, 56' and the lateral holes in the lower ends of the first and second legs 156, 156', and are threadably fitted with nuts.

The first end 74 of the front brace 72 is secured to the exterior flange 159 of the first leg 156 by two metal clinches. Similarly, the second end of the front brace 72 is secured to the exterior flange 159 of the second leg 156' by two metal clinches. First and second mounting plates 170, 170' are secured to the first and second legs 156, 156' above the front brace 72. Each of the first and second mounting plates 170, 170' extend forward from the first and second legs 156, 156' and have a mounting hole formed therein.

The door hinge support 76 is secured between the first and second mounting plates 170, 170' by the hinge pins 80. The hinge pins 80 extend through the mounting holes in the first and second mounting plates 170, 170' and are securely received within the inner bore 77 at the first and second ends 78*a*, 78*b* of the door hinge support 76, respectively. The door hinge support 76 extends behind the outer panel 185.

The first side member 187 and the second side member are respectively secured to the first and second hinge arms 110, 110'. The first and second hinge arms 110, 110' are pivotally connected to the first and second mounting plates 170, 170' by the hinge pins 80, which extend through the openings in the elbows 112. Together, the first and second mounting plates 170, 170', the first and second hinge arms 110, 110', the door hinge support 76 and the hinge pins 80 form a hinge structure that permits the door 180 to pivot about a horizontal axis passing through the hinge pins 80. The horizontal axis is located only slightly above a bottom edge of the door 180. Thus, the door 180 has a short bottom portion and is considered a "short door".

It should be appreciated that the door hinge support 76 affords the same benefits in the washer 150 of the second embodiment as in the washer 100 of the first embodiment. The door hinge support 76 helps prevent the first and second mounting plates 170, 170' from moving laterally out of plane with the first and second ends 78*a*, 78*b* of the door hinge support 76 and, thus, substantially prevents lateral movement of the door 180.

Although the preferred embodiments of this invention have been shown and described, it should be understood that various modifications and rearrangements of the parts may be resorted to without departing from the scope of the invention as disclosed and claimed herein.

What is claimed is:

1. A washer comprising:

a tub defining a wash chamber with a front opening, said tub having a bottom wall and opposing side walls;

a front frame having a pair of vertical members respectively disposed adjacent to the opposing side walls of the tub toward the front opening, said vertical members each having a lower end;

a pair of front supports each having a neck and a nose, said necks being respectively secured to the lower ends of the vertical members, and said noses extending forward from the necks;

a door pivotally secured to the noses of the front supports so as to be movable between an open position and a closed position;

a door hinge support secured between the noses of the front supports so as to secure the front supports from lateral movement.

2. The washer of claim 1 wherein the door hinge support is comprised of:

a cylindrical body having a pair of opposing ends, said body defining an inner bore that extends through the opposing ends; and a plurality of fins extending lengthwise along the body and projecting radially outward therefrom.

3. The washer of claim 2 wherein the door hinge support is composed of aluminum.

4. The washer of claim 2 wherein the door is comprised of:

a reinforcement frame having a pair of opposing side members;

a liner secured to the reinforcement frame; and an outer panel disposed over the reinforcement frame and the liner, said outer panel being disposed in front of, and extending below, the door hinge support.

5. The washer of claim 4 wherein the noses of the front supports each define a mounting hole.

6. The washer of claim 5 further comprising:

a pair of hinge arms each defining an opening, said hinge arms being secured to the opposing side members of the door and being disposed adjacent to the noses of the front supports such that the openings are aligned with the mounting holes in the noses so as to form a pair of hinge passages; and a pair of hinge pins respectively extending through the hinge passages and into the inner bore at the opposing ends of the door hinge support, thereby pivotally securing the door to the front supports and securing the door hinge support between the noses of the front supports.

7. The washer of claim 6 wherein the hinge arms each comprise a protruding inner surface, a depressed outer surface and an annular bearing surface disposed within the opening, and wherein the front supports each further comprise an indented exterior surface and a raised inner surface.

8. The washer of claim 7 wherein the protruding inner surfaces of the hinge arms respectively adjoin the indented exterior surfaces of the front supports.

9. The washer of claim 8 wherein the hinge pins each comprise a head and a body, said heads adjoining the depressed outer surfaces of the hinge arms, and said bodies being secured within the annular bearing surfaces in the hinge arms and the inner bore in the door hinge support.

10. The washer of claim 9 wherein the opposing ends of the door hinge support are substantially flush with the raised interior surfaces of the front supports.

11. A washer comprising:

a tub defining a wash chamber with a front opening, said tub having a bottom wall and opposing side walls;

a front frame having a pair of legs respectively disposed adjacent to the opposing side walls of the tub toward the front opening;

a pair of mounting plates secured to the legs of the front frame and extending forward therefrom, said mounting plates each defining a mounting hole;

a door having a pair of opposing side members;

a pair of hinge arms secured to the opposing side members of the door, said hinge arms each defining an opening, said hinge arms being disposed adjacent to the mounting plates such that the openings in the hinge arms are aligned with the mounting holes in the mounting plates so as to form a pair of hinge passages;

a door hinge support extending between the mounting plates and having opposing ends, said door hinge support defining an inner bore that extends through the opposing ends; and a pair of hinge pins respectively extending through the hinge passages and being securely received within the inner bore at the opposing ends of the door hinge support, thereby pivotally securing the door to the mounting plates and securing the door hinge support between the mounting plates.

12. The washer of claim 11 further comprising a rear frame that helps vertically support the tub, said rear frame comprising:

a pair of vertical legs disposed rearward of the legs of the front frame, said vertical legs each having upper and lower ends; and a pair of horizontal legs having outer ends, said horizontal legs being respectively secured to the lower ends of the vertical legs and extending forward therefrom to the outer ends, said horizontal legs being respectively secured to the legs of the front frame toward the outer ends.

13. The washer of claim 12 further comprising a front brace secured between the legs of the front frame.

14. The washer of claim 12 wherein the door is pivotable between an open position, wherein the door is substantially horizontal and is spaced from the access opening, and a closed position, wherein the door is substantially vertical and closes the access opening.

15. The washer of claim 14 wherein the hinge arms each comprise an elongated body.

16. The washer of claim 15 further comprising a pair of springs secured between the elongated bodies of the hinge arms and the horizontal legs of the rear frame, said springs biasing the door to pivot upward toward the closed position.

17. A washer comprising:

a tub defining a wash chamber with a front opening, said tub having a bottom wall and opposing side walls;

a front frame having a pair of vertical members respectively disposed adjacent to the opposing side walls of the tub toward the front opening, said vertical members each having a lower end;

a pair of front supports each having a neck and a nose, said necks being respectively secured to the lower ends of the vertical members, said noses extending forward from the necks and each having a mounting hole formed therein;

a door having a pair of opposing side members;

a pair of hinge arms secured to the opposing side members of the door, said hinge arms each defining an opening, said hinge arms being disposed adjacent to the noses of the front supports such that the openings in the hinge arms are aligned with the mounting holes in the noses so as to form a pair of hinge passages;

a door hinge support extending between the noses of the front supports and having opposing ends, said door hinge support defining an inner bore that extends through the opposing ends; and a pair of hinge pins respectively extending through the hinge passages and being securely received within the inner bore at the opposing ends of the door hinge support, thereby pivotally securing the door to the front supports and securing the door hinge support between the noses of the front supports.

18. The washer of claim 17 wherein the front supports each further comprise an upright member, said upright members being disposed below the necks.

19. The washer of claim 18 further comprising a rear frame that helps vertically support the tub, said rear frame comprising:

a pair of vertical legs disposed rearward of the front supports, said vertical legs each having upper and lower ends; and a pair of horizontal legs having outer ends, said horizontal legs being respectively secured to the lower ends of the vertical legs and extending forward therefrom to the outer ends, said horizontal legs being respectively secured to the upright members of the front supports toward the outer ends.

20. The washer of claim 19 further comprising a front brace secured between the upright members of the front supports.

* * * * *